US005783548A

United States Patent [19]

Fredj et al.

[11] Patent Number: 5,783,548

[45] Date of Patent: Jul. 21, 1998

[54] STABLE LIQUID DETERGENT COMPOSITIONS INHIBITING DYE TRANSFER

[75] Inventors: Abdennaceur Fredj, Strombeek-Bever; Patrick Willy M. Goethals, Eeklo, both of Belgium

[73] Assignee: The Procter & Gamble Company, Cincinnati, Ohio

[21] Appl. No.: 777,567

[22] Filed: Dec. 31, 1996

Related U.S. Application Data

[63] Continuation of Ser. No. 432,128, filed as PCT/US93/10542, Nov. 3, 1993 published as WO94/11473, May 26, 1994, abandoned.

[30] Foreign Application Priority Data

Nov. 6, 1992 [EP] European Pat. Off. ..... 92870182

[51] Int. Cl.[6] ..... C11D 3/42; C11D 1/12

[52] U.S. Cl. ..... 510/324; 510/325; 510/351; 510/352; 510/357; 510/475

[58] Field of Search ..... 510/324, 325, 510/475

[56] References Cited

U.S. PATENT DOCUMENTS

| | | | |
|---|---|---|---|
| 3,714,050 | 1/1973 | Gray | 252/99 |
| 3,929,678 | 12/1975 | Laughlin et al. | 252/526 |
| 4,123,376 | 10/1978 | Gray | 252/99 |
| 4,146,496 | 3/1979 | Gray | 252/99 |
| 4,300,897 | 11/1981 | Gray | 8/111 |
| 4,545,919 | 10/1985 | Abel | 252/174.18 |
| 4,548,744 | 10/1985 | Connor | 252/545 |
| 5,451,341 | 9/1995 | White | 252/547 |
| 5,466,802 | 11/1995 | Panandiker et al. | 544/193.2 |

FOREIGN PATENT DOCUMENTS

| | | | |
|---|---|---|---|
| 265 257 A2 | 4/1988 | European Pat. Off. | C11D 3/37 |
| 508 034 A1 | 10/1992 | European Pat. Off. | C11D 3/37 |
| 581 752 A1 | 2/1994 | European Pat. Off. | C11D 3/00 |
| 2 814 329 | 10/1979 | Germany | C11D 3/28 |
| 3 840 056 | 5/1990 | Germany . | |
| 1 348 212 | 3/1974 | United Kingdom | C11D 3/28 |
| 2 137 221 | 10/1984 | United Kingdom | C11D 10/02 |
| WO 94/02579 | 2/1994 | WIPO | C11D 3/00 |
| WO 94/02580 | 2/1994 | WIPO | C11D 3/00 |
| WO 94/02581 | 2/1994 | WIPO | C11D 3/00 |
| WO 94/10277 | 5/1994 | WIPO | C11D 1/75 |

*Primary Examiner*—Ellen M. McAvoy

*Attorney, Agent, or Firm*—Ken K. Patel; Kim W. Zerby; Jacobus C. Rasser

[57] ABSTRACT

The present invention relates to inhibiting dye transfer compositions comprising:

(A) from 0.01% to 5% of a polyamine N-oxide polymer, (B) from 0.01% to 1% of a brightener, and (C) from 5% to 30% of a non-aromatic anionic surfactant.

19 Claims, No Drawings

STABLE LIQUID DETERGENT COMPOSITIONS INHIBITING DYE TRANSFER

This is a continuation, of application Ser. No. 08/432,128, filed as PCT/US93/10542, Nov. 3, 1993 published as WO94/11473, May 26, 1994, now abandoned.

TECHNICAL FIELD

The present invention relates to stable liquid detergent compositions inhibiting dye transfer

BACKGROUND OF THE INVENTION

Optical brighteners, also known as fluorescent whitening agents, are commonly used in laundry detergents. Brighteners deposit onto fabrics where they absorb ultraviolet radiant energy and reemit it as blue light. This reduces or eliminates any yellowish cast to fabrics and gives them a bright appearance.

However, it has been found to be difficult to create and maintain the brightener dispersed in liquid detergent compositions containing polymers which exhibit dye transfer inhibiting properties. These polymers are used to complex or absorb the fugitive dyes washed out of dyed fabrics before they have the opportunity to become attached to other articles in the wash.

Such polymers that have been used within detergent compositions to inhibit dye transfer are disclosed in EP-A-O 102 923, DE-A-2 814 329, FR-A-2 144 721 and EP-265 257.

Copending EP Patent Application 92202168.8 describes dye transfer inhibiting compostions comprising polyamine N-oxides containing polymers.

Surprisingly, it has now been found that improved storage stability of liquid detergent compositions comprising polyamine N-oxide containing polymers and brightener can be achieved by adding non-aromatic anionic surfactants.

According to the present invention, a dye transfer inhibiting composition comprising a brightener is provided which has improved stability upon storage.

SUMMARY OF THE INVENTION

The present invention relates to inhibiting dye transfer compositions comprising (a) from 0.01% to 5% of a polyamine N-oxide containing polymer (b) from 0.01% to 1% of a brightener (c) from 5% to 30% of a non-aromatic anionic surfactant.

DETAILED DESCRIPTION OF THE INVENTION

The compositions of the present invention comprise as essential elements (a) from 0.01% to 5% of a polyamine N-oxide polymer (b) from 0.01% to 1% of a brightener (c) from 5% to 30% of a non-aromatic anionic surfactant A) Polyamine N-oxide containing polymers The polyamine N-oxide polymers contain units having the following structure formula

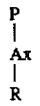

wherein P is a polymerisable unit, whereto the N—O group can be attached to or wherein the N—O group forms part of the polymerisable unit or a combination of both.

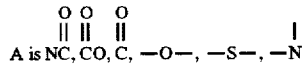

A is NC, CO, C, —O—, —S—, —N—;

x is or O or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

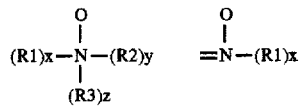

wherein R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine and derivatives thereof. Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 3:1 to 1:1000000. The polymers of the present invention actually encompass random or block copolymers where one monomer type is an amine N-oxide and the other monomer type is an N-oxide or not.

The amine oxide unit of the polyamine N-oxides has a pKa<10, preferably pKa<7, more preferred PKa<6. The polyamine oxides can be obtained in almost any degree of polymerisation. The degree of polymerisation is not critical provided the material has the desired water-solubility and dye-suspending power.

Typically, the average molecular weight is within the range of 500 to 1000,000 ; more preferred 1000 to 500,000 ; most preferred 5000 to 100,000.

The polyamine N-oxides of the present invention are typically present from 0.01 to 10% , more preferably from 0.05 to 1%, most preferred from 0.05 to 0.5 % by weight of the dye transfer inhibiting composition.

B) Brightener

Preferred brighteners according to the present invention are hydrophobic brighteners which have the general formula:

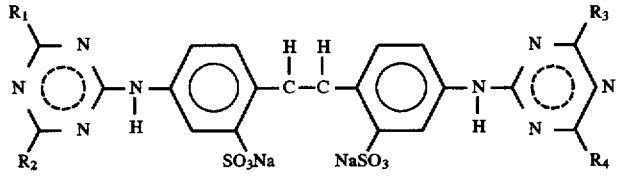

wherein $R_1$, $R_2$, $R_3$ and $R_4$ represent, selected independently, anilino, cyclohexylamino, piperazino, phenylenediamino, toluenediamino, morpholino, aminophenol, N-2-hydroxyethyl-N-methylamino, N-2-Bis-hydroxyethyl.

Suitable brightener species include any combination of the possible $R_{1-4}$ moieties. Examples of preferred brightener species are the tetra-anilino, tetra-piperazino, tetra-cyclohexylamino and combinations thereof such as for example the di-anilinodipiperazino; and the dianilino-dicyclohexylamino species.

Highly preferred for reasons of minimizing brightener staining are the tetraanilino derivatives, having the following formula : 4,4' -bis (4-anilino-6-anilino-s-triazin-2-yl) amino)-2,2'- stilbe ne disulfonic acid sodium salt (A). A preferred brightener system in the context of this invention contains at least 40% (by reference to the total amount of the detergent brightener) of the specific hydrophobic brightener referred to hereinbefore in combination with a conventional detergent brightener, e.g., a di-sulfonated dianilino, dimorpholino stilbene brightener.

Conventional detergent brighteners for use in combination with the hydrophobic species described hereinabove embrace common detergent brighteners inclusives of:

4,4(2H-naphtho(1,2-d)triazol-2-yl)-2-stilbenesulfonic acid, sodium salt; (i)

4,4$^1$-bis((4-anilino-6(N-2-hydroxyethyl-N-methylamino)-s-triazin-2-yl)amino)-2,2$^1$-stilbenedisulfonic acid disodium salt; (ii)

4,4$^1$-bis((4-anilino-6-morpholino-s-triazine-2-yl)amino)-2,2$^1$-stilbenedisulfonic acid, sodium salt; (iii)

2,2-(4,4$^1$-biphenylene divinylene)-dibenzenesulfonic acid, disodium salt; (ivi)

4,4$^1$-bis(4-phenyl-2H-1,2,3-triazol-2-yl) disodium salt (vi)

4,4$^1$-bis(4-anilino-6-morpholino-1,3,5-triazin-2-yl)amino)-2-stilbene sulfonate sodium salt. (vii)

C) Non-aromatic anionic surfactants

Non-aromatic anionic surfactants suitable for the present invention are generally disclosed in U.S. Pat. No. 3,929,678.

Classes of non-aromatic anionic surfactants include the classes are:

1. Ordinary alkali metal soaps such as the sodium, potassium, ammonium and alkylolammonium salts of higher fatty acids containing from 8 to 24 carbon atoms, preferably from 10 to 20 carbon atoms.
2. Water-soluble salts, preferably the alkali metal, ammonium and alkylolammonium salts, of organic sulfuric reaction products having in their molecular structure an alkyl group containing from 10 to 20 carbon atoms and a sulfonic acid or sulfuric acid ester group.

Examples of this group of anionic surfactants are the sodium and potassium alkylsulfates, especially those obtained by sulfating the higher alcohols (C8–C18 carbon atoms) such as those produced by reducing the glycerides of tallow or coconut oil; in straight chain or branched configuration.

Other anionic surfactants suitable for the present invention are the alkyl polyethoxylate sulfates, particulary those in which the alkyl group contains from 10 to 22, preferably from 12 to 18 carbon atoms, and wherein the polyethoxylate chain contains from 1 to 15 ethoxylate moieties.

Other anionic surfactants suitable for the present invention include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl ethylene oxide ether sulfates containing 1 to 10 units of ethylene oxide per molecule and wherein the alkyl group contains from 10 to 20 carbon atoms.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

Detergent ingredients

In another embodiment of the present invention, a liquid detergent composition is provided comprising the dye transfer inhibiting composition mixed with detergent ingredients. A wide range of surfactants can be used in the detergent composition of the present invention.

A typical listing of anionic, nonionic, ampholytic and zwitterionic classes, and species of these surfactants, is given in U.S. Pat. No. 3,664,961 issued to Norris on May 23, 1972.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula $$R^2-\underset{\underset{O}{\|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R-CH(COOH) CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid.

Other suitable water-soluble organic salts are the homo- or co-polymeric acids or their salts, in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Other components used in detergent compositions may be employed, such as enzymes and stabilizers or activators therefore, soil-suspending agents soil-release agents, optical brighteners, abrasives, bactericides, tarnish inhibitors, coloring agents, and perfumes. Especially preferred are combinations with enzyme technologies which also provide a type of color care benefit. Examples are cellulase for color maintenance/rejuvenation. Other examples are the polymers disclosed in EP 92870017.8 filed Jan. 31,1992 and enzyme oxidation scavengers disclosed in EP 92870018.6 filed Jan. 31, 1992.

Also particulary suitable are amine base catlyst stabilizers disclosed in EP 92870019.4 filed Jan. 31, 1992.

These components, particularly the enzymes, optical brighteners, coloring agents, and perfumes, should preferably be chosen such that they are compatible with the bleach component of the composition.

The liquid compositions according to the present invention can also be in "concentrated form"; in such case, the liquid detergent compositions according to the present invention will contain a lower amount of water, compared to conventional liquid detergents.

The following examples are meant to exemplify compositions of the present inventions, but are not necessarily meant to limit the scope of the invention.

Test procedure

To assess the stabilizing effect of the non-aromatic anionic surfactants, the stability of the brightener and polyamine N-oxide containing polymer incorporated in liquid detergent compositions were compared in the absence and presence of non-aromatic anionic surfactants. More in particular, the stability of polyamine N-oxide polymer/brightener was determined in the absence of ethoxylated surfactant and in the presence of ethoxylated surfactant.

Similar measurements were made for samples wherein the polyamine N-oxide was replaced by another dye transfer inhibiting polymer known in the art e.g polyvinylpyrrolidone. The stability was determined by visual inspection of the samples after one month of storage at room temperature/at 35° C./50° C. and at 4° C.

The following liquid detergent compositions were made:

| | I | II | III | IV |
|---|---|---|---|---|
| $C_{12}$–$C_{15}$ Alkyl sulfate | — | 19.0 | 21.0 | — |
| $C_{12}$–$C_{15}$ Alkyl ethoxylated sulfate | 23.0 | 4.0 | 4.0 | 25.0 |
| $C_{12}$–$C_{14}$ N-methyl glucamide | 9.0 | 9.0 | 9.0 | 9.0 |
| $C_{12}$–$C_{14}$ fatty alcohol ethoxylate | 6.0 | 6.0 | 6.0 | 6.0 |
| $C_{12}$–$C_{16}$ Fatty acid | 9.0 | 6.8 | 14.0 | 14.0 |
| Brightener FWA-36 | 0.05 | 0.05 | 0.05 | 0.05 |
| Polyvinyl pyrrolidone | 1.0 | 1.0 | — | — |
| Poly(4-vinylpyridine)-N-oxide | — | — | 0.5 | 0.5 |
| citric acid anhydrous | 6.0 | 4.5 | 3.5 | 3.5 |
| Diethylene triamine penta methylene phosphonic acid | 1.0 | 1.0 | 2.0 | 2.0 |
| Monoethanolamine | 13.2 | 12.7 | 12.8 | 11.0 |
| Propanediol | 12.7 | 14.5 | 13.1 | 10.0 |
| Ethanol | 1.8 | 1.8 | 4.7 | 5.4 |
| Enzymes | 2.4 | 2.4 | 2.0 | 2.0 |
| Terephtalate-based polymer | 0.5 | 0.5 | 0.5 | 0.5 |
| Boric acid | 2.4 | 2.4 | 2.8 | 2.8 |
| 2-butyl-Octanol | 2.0 | 2.0 | 2.0 | 2.0 |
| DC 3421 R (1) | 0.3 | 0.4 | 0.3 | 0.4 |
| FF 400 R (2) | | | | |
| Water & Minors | | up to 100% | | |

(1) DC 3421 is a silicone oil commercially available from Dow Corning.
(2) is a silicone glycol emulsifier available from Dow Corning.

Liquid detergent compositions according to the present invention, containing the brightener/polyamine N-oxide/non-aromatic anionic surfactant system have a translucent appearance.

In the abscence of non-aromatic anionic surfactants, the brightener starts to bind with the polyamine N-oxide containing polymer resulting in a complex, which in turn flocculates and changes the visual appearance of the bulk solution from translucent to transparent. In the presence of non-aromatic anionic surfactant the brightener remains homogeneously dispersed in the liquid, resulting in a translucent liquid even after long periods of storage. Liquid detergent compositions containing the brightener/polyvinylpyrrolidone/non-aromatic anionic surfactant system have a transparent appearance both in the presence or abscense of non-aromatic anionic surfactant.

We claim:

1. A liquid dye transfer inhibiting composition essentially free of aromatic anionic surfactants comprising:

(a) from 0.01% to 5% of a polyamine N-oxide containing polymer (b) from 0.01% to 1% of a brightener (c) from 5% to 30% of non-aromatic anionic surfactant wherein said brightener comprises at least 40% or more of a hydrophobic brightener.

2. A dye transfer inhibiting composition according to claim 1 wherein the non-aromatic anionic surfactant is an ethoxylated surfactant.

3. A dye transfer inhibiting composition according to claim 2 wherein the polyamine N-oxide is polyvinylpyridine N-oxide.

4. A dye transfer inhibiting composition according to claim 2 which is a detergent additive, in the form of a liquid.

5. A detergent composition which comprises a dye transfer inhibiting composition according to claim 1 further comprising:

an additional amount of surfactant essentially free of aromatic anionic surfactants a builder; and an enzyme.

6. A liquid dye transfer inhibiting composition comprising:

(a) from 0.01% to 5% of an polyamine N-oxide containing polymer;

(b) from 0.01% to 1% of a brightener;

(c) from 5% to 30% of an anionic surfactant essentially free of non-aromatic anionic surfactants; and wherein said brightener comprises at least 40% or more of a hydrophobic brightener.

7. The liquid dye transfer inhibiting composition according to claim 6, wherein the anionic surfactant comprises a mixture of sulfonate and sulphate surfactants having a weight ratio of sulfonate to sulphate in the range of from 5:1 to 1:2.

8. The liquid dye transfer inhibiting composition according to claim 6, wherein the anionic surfactant comprises a mixture of sulfonate and sulphate surfactants having a weight ratio of sulfonate to sulphate in the range of from 3:1 to 2:3.

9. The liquid dye transfer inhibiting composition according to claim 6, wherein the anionic surfactant comprises a mixture of sulfonate and sulphate surfactants having a weight ratio of sulfonate to sulphate in the range of from 3:1 to 1:1.

10. The dye transfer inhibiting composition according to claim 6, wherein the polyamine N-oxide containing polymer comprises amine and amine N-oxide groups and those groups are present within the range of ratios of amine to amine N-oxide of 10:1 to 1:1,000,000.

11. The liquid dye transfer inhibiting composition according to claim 6, wherein the polyamine N-oxide containing polymer comprises amine oxide units having a pKa less than 10.

12. The liquid dye transfer inhibiting composition according to claim 6, wherein the polyamine N-oxide containing polymer comprises amine oxide units having a pKa less than 6.

13. The liquid dye transfer inhibiting composition according to claim 6, wherein the polyamine N-oxide containing polymer has a molecular weight within the range of 500 to 1,000,000.

14. The liquid dye transfer inhibiting composition according to claim 6, wherein the polyamine N-oxide containing polymer has an average molecular weight within the range of 1,000 to 500,000.

15. The liquid dye transfer inhibiting composition according to claim 6, wherein the polyamine N-oxide containing polymer has an average molecular weight within the range of 5,000 to 100,000.

16. A detergent composition which comprises a liquid dye transfer inhibiting composition according to claim 6, further comprising:

an additional amount of surfactant essentially free of aromatic anionic surfactants;

a builder; and an enzyme.

17. The detergent composition according to claim 16, wherein the builder comprises from 10% to 80% by weight of the detergent composition.

18. The detergent composition according to claim 16, wherein the builder comprises from 20% to 70% by weight of the detergent composition.

19. The detergent composition according to the claim 16, wherein the builder comprises from 30% to 60% by weight of the detergent composition.

* * * * *